US011946337B2

(12) United States Patent
Roth et al.

(10) Patent No.: US 11,946,337 B2
(45) Date of Patent: Apr. 2, 2024

(54) LOCK TOOL FOR A SUBSURFACE SAFETY VALVE

(71) Applicant: SAUDI ARABIAN OIL COMPANY, Dhahran (SA)

(72) Inventors: Brian A. Roth, Dhahran (SA); Jinjiang Xiao, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 226 days.

(21) Appl. No.: 17/455,022

(22) Filed: Nov. 16, 2021

(65) Prior Publication Data

US 2023/0151713 A1 May 18, 2023

(51) Int. Cl.

| | |
|---|---|
| ***E21B 34/06*** | (2006.01) |
| ***E21B 23/02*** | (2006.01) |
| ***E21B 33/10*** | (2006.01) |

(52) U.S. Cl.

CPC ..... *E21B 34/06* (2013.01); *E21B 23/02* (2013.01); *E21B 33/10* (2013.01)

(58) Field of Classification Search

CPC ..... E21B 34/06; E21B 23/02; E21B 33/10; E21B 33/1208; E21B 34/14

See application file for complete search history.

(56) References Cited

U.S. PATENT DOCUMENTS

| | | | | |
|---|---|---|---|---|
| 6,012,527 | A * | 1/2000 | Nitis | E21B 47/024 166/50 |
| 7,665,537 | B2 | 2/2010 | Patel et al. | |
| 7,703,510 | B2 * | 4/2010 | Xu | E21B 34/142 166/308.1 |
| 9,334,702 | B2 | 5/2016 | Allen et al. | |
| 11,680,459 | B1 * | 6/2023 | Al-Ramadhan | E21B 34/14 166/285 |
| 11,732,549 | B2 * | 8/2023 | Egbe | E21B 33/16 166/285 |
| 2014/0054047 | A1 * | 2/2014 | Zhou | E21B 43/106 166/207 |
| 2017/0145784 | A1 * | 5/2017 | Zhou | E21B 33/146 |
| 2018/0135384 | A1 * | 5/2018 | Abdelaziz | E21B 43/128 |

FOREIGN PATENT DOCUMENTS

GB 2439399 A 12/2007

* cited by examiner

*Primary Examiner* — Yong-Suk (Philip) Ro

(74) *Attorney, Agent, or Firm* — Osha Bergman Watanabe & Burton LLP

(57) ABSTRACT

A system includes a subsurface safety valve and a lock tool. The subsurface safety valve is installed within the production tubing and has a main bore delineated by an inner circumferential surface of the subsurface safety valve and a lock profile machined into the inner circumferential surface of the subsurface safety valve. The lock tool is movably disposed around a conduit and has a locking dog configured to engage with the lock profile of the subsurface safety valve and a conduit seal made of a swellable elastomer. The conduit seal is activated by an activation fluid and has an expanded position and an unexpanded position.

18 Claims, 7 Drawing Sheets

LOCK TOOL FOR A SUBSURFACE SAFETY VALVE

BACKGROUND

In the oil and gas industry, hydrocarbons are located in reservoirs far beneath the Earth's surface. Wells are drilled into these reservoirs to produce said hydrocarbons. A well's structure is made of a plurality of casing strings cemented in place. A production string is set within the innermost casing string. The production string is used to provide a conduit for production fluids, such as hydrocarbons, to flow from the reservoir to the surface of the Earth. The production string is made of production tubing and downhole production equipment. A subsurface safety valve (SSSV) is almost always installed as part of the production tubing to aid in well control.

A SSSV is a valve that is designed to shut off flow, through the production tubing, in a well control scenario. A SSSV may be deep-set or shallow-set. A deep-set SSSV is set downhole from the downhole production equipment. Thus, when a tool needs to be run into the production tubing to workover the downhole production equipment, a conduit, such as wireline, need not pass through the deep-set SSSV. However, a deep-set SSSV leaves a significant volume of hydrocarbons between the deep-set SSSV and the surface which creates more operational risk. A shallow-set SSSV is set up hole from the downhole production equipment and may be set much closer to the surface. However, the shallow-set SSSV must be designed in a way to shut off flow when a conduit is run through the production tubing.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

The present disclosure presents, in accordance with one or more embodiments, a system and a method for production tubing. The system includes a subsurface safety valve and a lock tool. The subsurface safety valve is installed within the production tubing and has a main bore delineated by an inner circumferential surface of the subsurface safety valve and a lock profile machined into the inner circumferential surface of the subsurface safety valve. The lock tool is movably disposed around a conduit and has a locking dog configured to engage with the lock profile of the subsurface safety valve and a conduit seal made of a swellable elastomer. The conduit seal is activated by an activation fluid and has an expanded position and an unexpanded position.

The method includes providing a subsurface safety valve installed within the production tubing, the subsurface safety valve comprising a main bore and a lock profile. The method further includes running a conduit, having a lock tool movably disposed around the conduit, into the main bore of the subsurface safety valve, the lock tool comprising a locking dog and a conduit seal, engaging the locking dog of the lock tool with the lock profile of the subsurface safety valve, and activating the conduit seal, using an activation fluid, to expand the conduit seal from an unexpanded position to an expanded position.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Subsurface safety valves (SSSV) are used to shut off fluid flow within tubing, such as production tubing. When a conduit, such as wireline or coiled tubing, is run through a shallow-set SSSV, the shallow-set SSSV must be able to shut off flow between the shallow-set SSSV and the conduit without shearing the conduit. Therefore, a design that allows flow to be completely shut off within production tubing while the conduit is present within the shallow-set SSSV is beneficial. As such, embodiments presented herein provide systems and methods that use a lock tool, having a conduit seal, to engage with a SSSV and block fluid flow within the production tubing. The embodiments disclosed herein may be used for both a shallow-set SSSV and a deep-set SSSV without departing from the scope of the disclosure herein.

Figure 1:
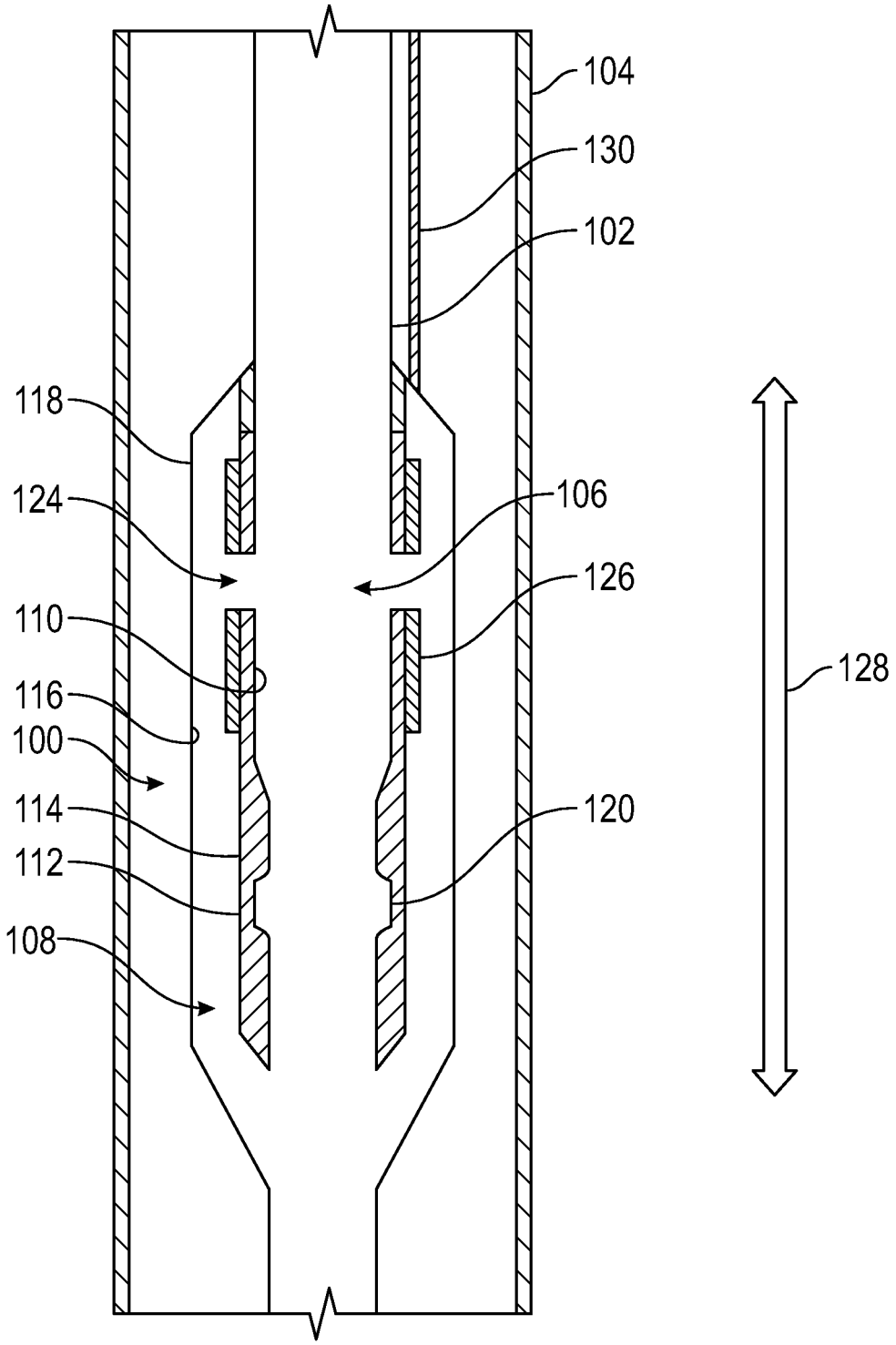
FIG. 1 shows a cross section of a system having a subsurface safety valve (SSSV) in accordance with one or more embodiments.

FIG. 1 shows a cross section of a system having a subsurface safety valve (SSSV) (100) in accordance with one or more embodiments. The SSSV (100) is installed within production tubing (102). Production tubing (102) may be any type of tubing that provides a possible conduit for the flow of fluids. For example, the production tubing (102) may be a plurality of joints of steel pipe threaded together. The SSSV (100) may be threaded into the production tubing (102) between two joints of steel pipe. In other embodiments, the SSSV (100) may be welded between two joints of steel pipe.

In one or more embodiments, the production tubing (102), along with the SSSV (100), is located within a casing string (104). The casing string (104) may be made of a plurality of joints of steel pipe threaded together, the steel pipes of the casing string (104) having a larger inner and outer diameter than the inner and outer diameter of the production tubing (102). In further embodiments, the casing string (104) is a component of a well, and the casing string (104) and the production tubing (102) extend to a surface location located anywhere along the surface of the Earth.

The SSSV (100) may be a sliding-sleeve style tubing-retrievable SSSV (100). The SSSV (100) has a main bore (106) and an outer bore (108). The main bore (106) is delineated by an inner circumferential surface (110) of a first tube (112). The outer bore (108) is delineated by an outer circumferential surface (114) of the first tube (112) and an inner surface (116) of a second tube (118). The first tube (112) and the second tube (118) are cylinders, that may have inconsistent inner diameters and inconsistent outer diameters. The first tube (112) and the second tube (118) may be made of any material that can withstand downhole conditions, such as steel.

A lock profile (120) may be machined into the inner circumferential surface (110) of the first tube (112). The lock profile (120) may act as a polished bore receptacle for the lock tool (200) disclosed below. Further, the first tube (112) may have a maximum inner diameter that is the same as the inner diameter of the production tubing (102) such that near-full bore access is provided to allow for the passage of workover tools. The maximum outer diameter of the second tube (118) may be greater than the outer diameter of the production tubing (102), yet less than the inner diameter of the casing string (104), in order to fit the outer bore (108) while at the same time allowing near-full bore access in the main bore (106).

The first tube (112) may have an opening (124) that hydraulically connects the outer bore (108) to the main bore (106). A closure sleeve (126) is installed on the outer circumferential surface (114) of the first tube (112). The closure sleeve (126) may be a sliding sleeve that covers the opening (124) of the first tube (112) to prevent hydraulic communication between the outer bore (108) and the main bore (106). The closure sleeve (126) may move in a vertical direction (128). Movement in the vertical direction (128) allows the closure sleeve (126) to uncover the opening (124) and allow for hydraulic communication between the outer bore (108) and the main bore (106).

The closure sleeve (126) is shown in the open (i.e., uncovered) position. The closure sleeve (126) may be powered using a hydraulic control line (130). The hydraulic control line (130) may use a hydraulic fluid to apply a pressure to the closure sleeve (126). The closure sleeve (126) may naturally be in the closed/covered position and may transition to the open/uncovered position using the pressure applied by the hydraulic fluid. The hydraulic control line (130) may extend to and be connected to a hydraulic control unit at the surface. In further embodiments, a rupture disk (not pictured) may be added to the SSSV (100) to provide an alternate means to equalize pressure across the SSSV (100) should the closure sleeve (126) fail to open.

Figure 2:
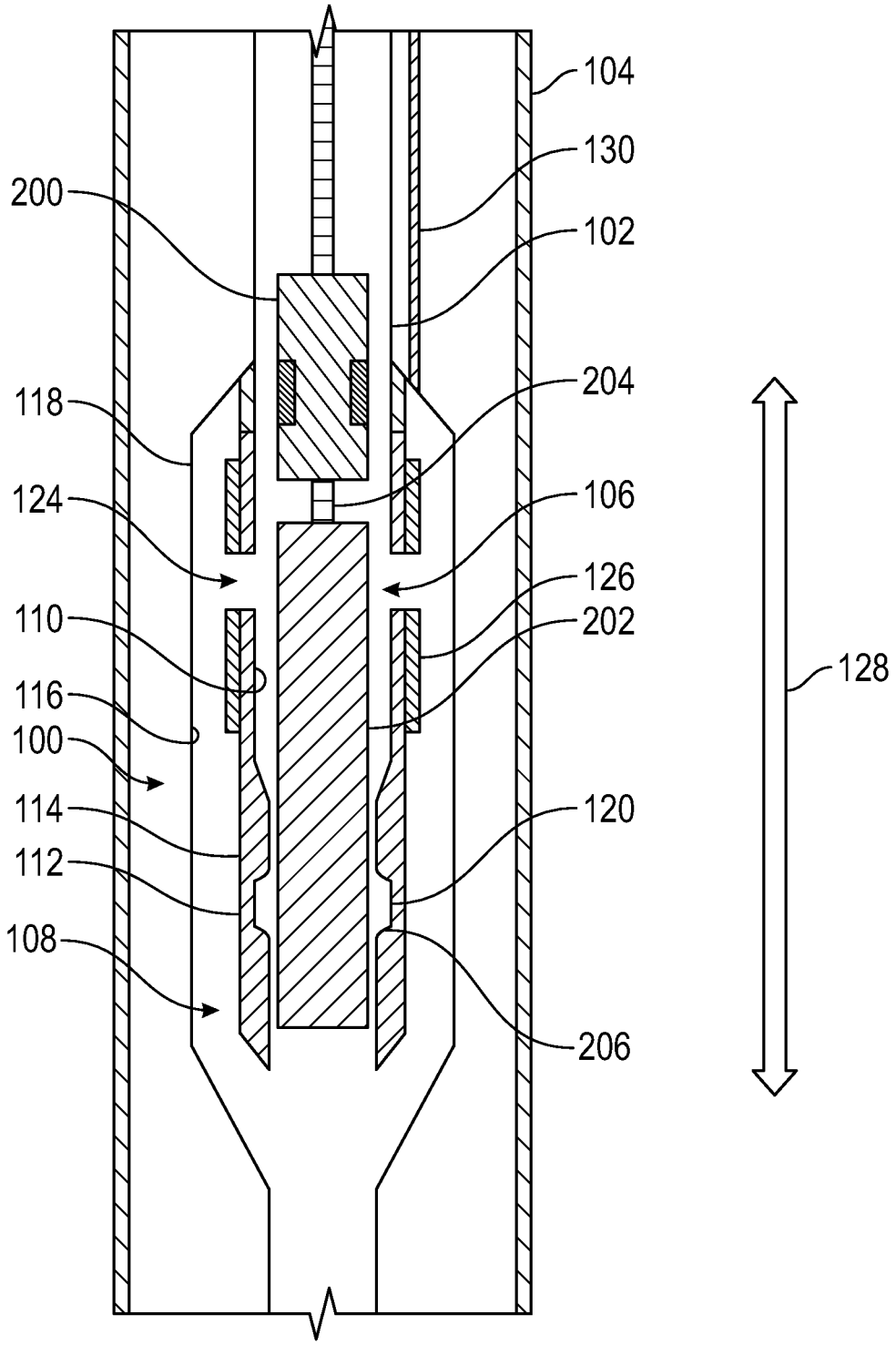
FIG. 2 shows a partial cross section of a system having a lock tool and a SSSV in accordance with one or more embodiments.

FIG. 2 shows a partial cross section of a system having a lock tool (200) and a SSSV (100) in accordance with one or more embodiments. The SSSV (100) is installed in production tubing (102) and the production tubing (102) is deployed in a casing string (104). Components in FIG. 2 that are the same as or similar to components shown in FIG. 1 have not been redescribed for purposes of readability and have the same function as described above.

A bottom hole assembly (BHA) (202) is shown being deployed into the production tubing (102). The BHA (202) may be any downhole tool that would be deployed in production tubing (102) such as a workover tool, a logging tool, etc. The BHA (202) is run into the production tubing (102) on a conduit (204). The conduit (204) may be a wireline, slickline, coiled tubing, etc. The lock tool (200) is movably disposed around the conduit (204). The lock tool (200) may be located up hole from the BHA (202) along the conduit (204). The lock tool (200) may be slid over the conduit (204) prior to the BHA (202) being installed. The lock tool (200) may be connected to the conduit (204) using a shear-able mechanism.

The lock tool (200) is designed to land out in the lock profile (120) of the SSSV (100). The lock profile (120) has a no-go shoulder (206) that is sized to prevent the lock tool (200) from traveling downhole from the SSSV (100). The no-go shoulder (206) may be a sharp 90-degree shoulder, or the no-go shoulder (206) may be a tapered shoulder as depicted in FIG. 2. In one or more embodiments, the lock tool (200) has a length of three feet.

Figure 3:
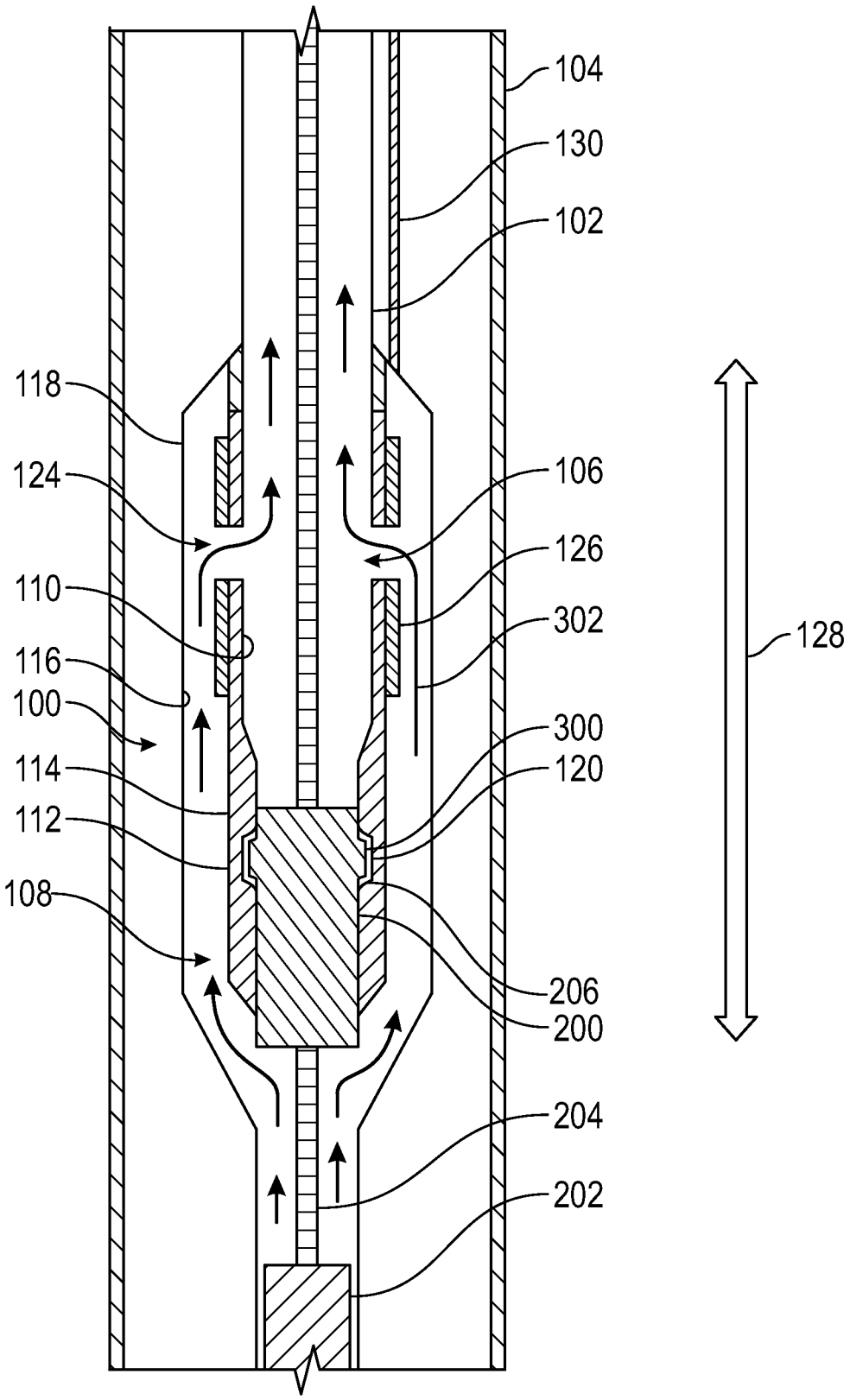
FIG. 3 shows a partial cross section of a system having a lock tool landed out in a SSSV in accordance with one or more embodiments.

FIG. 3 shows a partial cross section of a system having a lock tool (200) landed out in a SSSV (100) in accordance with one or more embodiments. The lock tool (200) may be the same lock tool (200) described in FIG. 2 and the SSSV (100) may be the same SSSV (100) described in FIGS. 1 and 2. Components in FIG. 3 that are the same as or similar to components shown in FIGS. 1 and 2 have not been redescribed for purposes of readability and have the same function as described above.

The lock tool (200) may be landed out within the SSSV (100) using one or more locking dogs (300). The locking dogs (300) may be initially located within the lock tool (200), such that the lock tool (200) has a flush surface. When the lock tool (200) is in position within the lock profile (120), the locking dogs (300) may be actuated to jut out from the lock tool (200). The locking dogs (300) may be actuated using pressure actuation or mechanical actuation. The locking dogs (300) engage into the lock profile (120) to keep the lock tool (200) in place within the SSSV (100). The no-go shoulder (206) aids in keeping the lock tool (200) in place within the SSSV (100).

As explained above and in one or more embodiments, the lock tool (200) may be connected to the conduit (204) using a shear-able mechanism. Once the lock tool (200) is fixed within the lock profile (120), continued downward movement of the conduit (204) shears the shear-able mechanism to release the lock tool (200) from the conduit (204). After the lock tool (200) has been released from the conduit (204), the conduit (204) is free to move within the lock tool (200) in the vertical direction (128). Thus, the BHA (202) may continue to be lowered/pulled into/from the production tubing (102).

Further, when the lock tool (200) is engaged in the lock profile (120), the flow of fluid (302) is prevented from flowing through the main bore (106) and is directed through the outer bore (108). With the closure sleeve (126) in the open position, the fluid (302) is able to flow past the lock tool (200) through the opening (124) and back into the main bore (106) of the SSSV (100). While the BHA (202) is being lowered into the production tubing (102), the closure sleeve (126) may be kept in the open position to allow for fluid (302) circulation. FIG. 3 shows the closure sleeve (126) in the open position with fluid (302) circulation.

When a well control incident occurs, the closure sleeve (126) may be placed in the closed position by releasing the hydraulic pressure applied through the hydraulic control line (130). With the lock tool (200) engaged the lock profile (120) and the closure sleeve (126) in the closed position, the fluid (302) is unable to pass through the SSSV (100) using the main bore (106) or the outer bore (108). However, fluid (302) may still pass through an annulus located between the conduit (204) and the lock tool (200). Thus, the lock tool (200) is equipped with a conduit seal (400), described below, to prevent fluid (302) from passing between the lock tool (200) and the conduit (204).

Figure 4B:
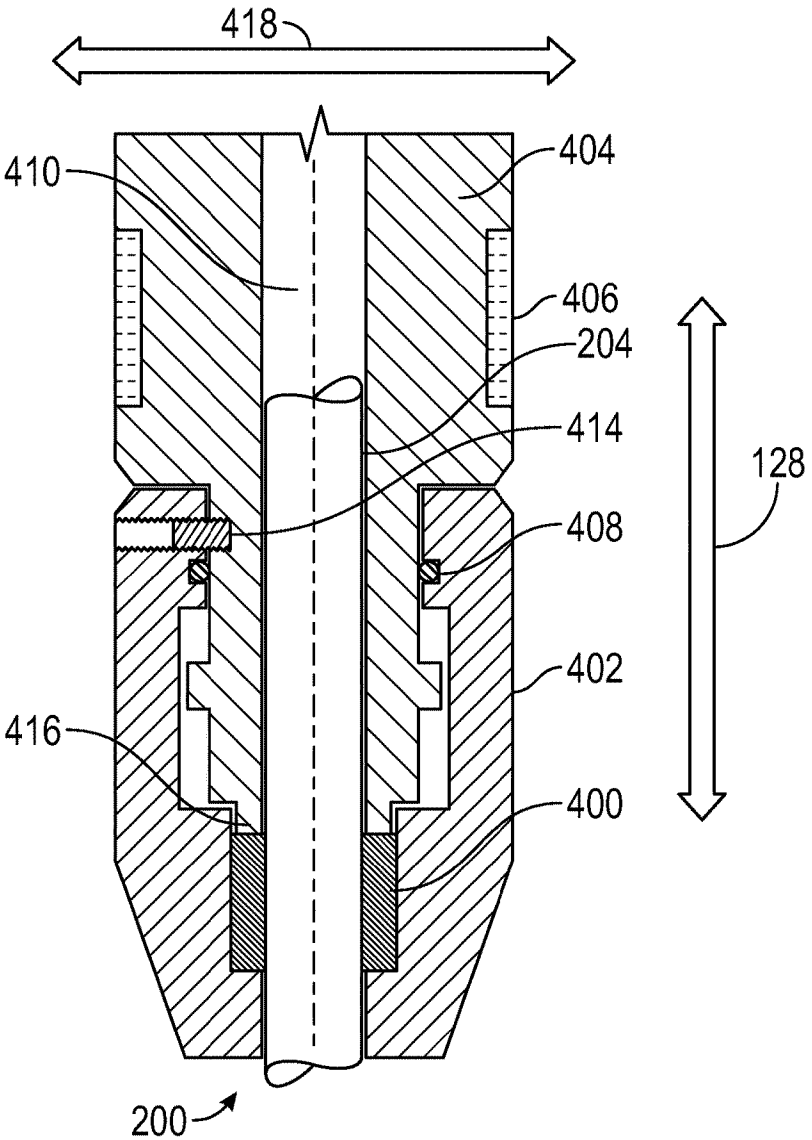
FIGS. 4*a* and 4*b* show a cross section of a lock tool in accordance with one or more embodiments.
Figure 4A:
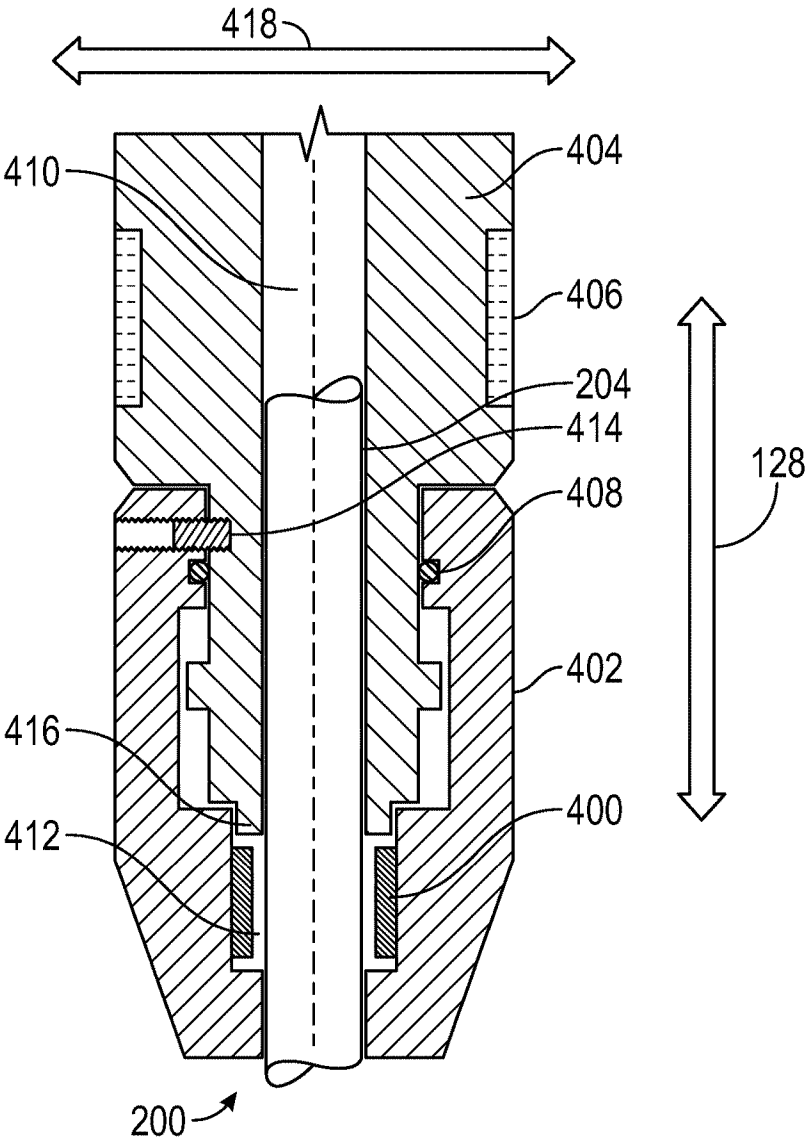

FIGS. 4*a* and 4*b* show a cross section of a lock tool (200) in accordance with one or more embodiments. Specifically, FIG. 4*a* shows the conduit seal (400) of the lock tool (200) in an unexpanded position, and FIG. 4*b* shows the conduit seal (400) of the lock tool (200) in an expanded position. Components in FIGS. 4*a* and 4*b* that are the same as or similar to components shown in FIGS. 1-3 have not been redescribed for purposes of readability and have the same function as described above.

The body of the lock tool (200) may include a conduit seal housing (402) and a lock tool housing (404). A profile seal (406) may be disposed around the lock tool housing (404). When the lock tool (200) is engaged in the SSSV (100) as shown in FIG. 3, the profile seal (406) creates a seal between the lock tool housing (404) and the inner circumferential surface (110) of the first tube (112) of the SSSV (100). Thus, fluid (302) is prevented from migrating between the lock tool (200) and the first tube (112). Further, a housing seal (408) may be located between the lock tool housing (404) and the conduit seal housing (402). The housing seal (408) prevents fluid (302) from migrating between the lock tool housing (404) and the conduit seal housing (402). The housing seal (408) and the profile seal (406) may be any type of seal known in the art, such as a rubber O-ring.

The lock tool housing (404) and the conduit seal housing (402) may be made of any durable material known in the art, such as steel. The locking dogs (300) described in FIG. 3 may be located on a section of the lock tool housing (404) not pictured in FIGS. 4*a* and 4*b*. Both the lock tool housing (404) and the conduit seal housing (402) may have a conduit bore (410) through which the conduit (204) may be disposed. An annulus (412) may exist between the conduit (204) and the conduit seal housing (402) as shown in FIG. 4*a*. Fluid (302) may flow through this annulus (412). The conduit seal (400) is located within the conduit seal housing (402) and is located between the conduit bore (410) and the conduit seal housing (402). The annulus (412) may also exist between the conduit seal (400) and the conduit (204) when the conduit seal (400) is the unexpanded position.

A portion of the lock tool housing (404) is located within the conduit seal housing (402). The portion of the lock tool housing (404) may be held in place within the conduit seal housing (402) using a retention device (414). The retention device (414) may extend from the conduit seal housing (402) to the lock tool housing (404). The retention device (414) may be any retention device (414) known in the art, such as shear pins, shear rings, etc. A distal end (416) of the lock tool housing (404) is located proximate to the conduit seal (400) as shown in FIG. 4*a*.

When the lock tool housing (404) is retained within the conduit seal housing (402), the distal end (416) of the lock tool housing (404) prevents the conduit seal (400) from expanding, to a great extent, in the vertical direction (128), thus the conduit seal (400), when placed in the expanded position, primarily expands in the horizontal direction (418) to seal the annulus (412) between the conduit seal (400) and the conduit (204) as shown in FIG. 4*b*.

The conduit seal (400) is made of a swellable elastomer that may swell when activated by an activation fluid (302). When the conduit seal (400) is put in contact with the activation fluid, the conduit seal (400) is activated and swells from the unexpanded position, as shown in FIG. 4*a*, to the expanded position, as shown in FIG. 4*b*. The expanded position of the conduit seal (400) has an inner diameter smaller than an outer diameter of the conduit (204). The unexpanded position may have an inner diameter greater than an outer diameter of the conduit (204). The activation fluid (302) may be hydrocarbons, water, or other fluids (302).

With the conduit seal (400) in the expanded position and the lock tool (200) retained in the SSSV (100), fluid (302) is unable to pass through the conduit bore (410) of the lock tool (200) and the fluid (302) is unable to pass through the main bore (106) of the SSSV (100). Thus, fluid (302) is directed to flow through the outer bore (108) of the SSSV (100). When the closure sleeve (126) is in the closed position, fluid (302) is unable to re-enter the main bore (106) of the SSSV (100) through the opening (124) in the first tube (112) and pressure is completely isolated across the SSSV (100). Further, the conduit seal (400), in the expanded position, prevents the conduit (204) from moving in the vertical direction (128). In other embodiments, the conduit seal (400) may include back-up rings (not pictured) on either side of the conduit seal (400) to provide extrusion resistance against downhole differential pressure.

Figure 5:
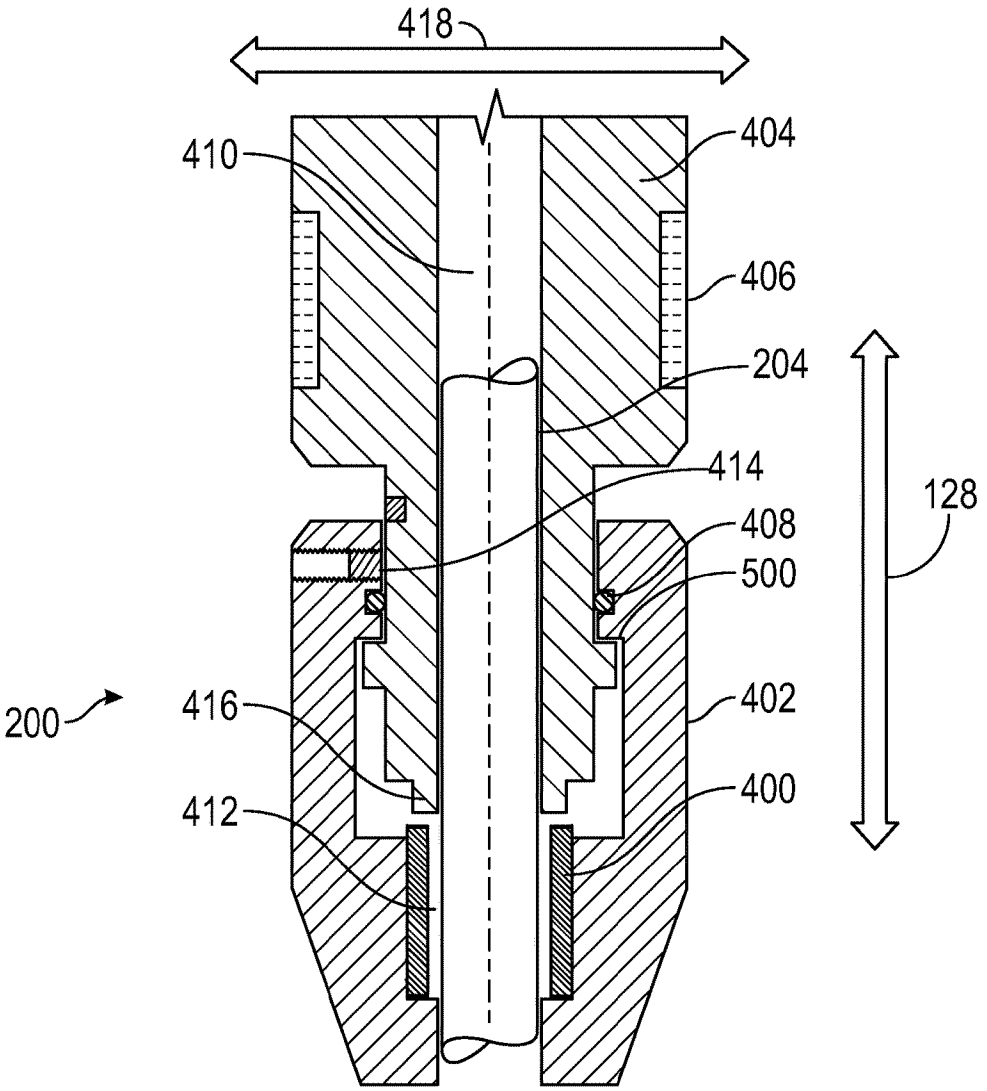
FIG. 5 shows a retention device of a lock tool in the sheared position in accordance with one or more embodiments.

The retention device (414) has a sheared position and an unsheared position. FIGS. 4*a* and 4*b* show the retention device (414) in the unsheared position. The unsheared position holds the lock tool housing (404) in a fixed position against the conduit seal (400). The sheared position allows the lock tool housing (404) to move away from the conduit seal (400). FIG. 5 shows the retention device (414) of a lock tool (200) in the sheared position in accordance with one or more embodiments. Components in FIG. 5 that are the same as or similar to components shown in FIGS. 1-4*b* have not been redescribed for purposes of readability and have the same function as described above.

The retention device (414) may be put in the sheared position by applying pressure above the lock tool (200) through the production tubing (102). This places a shearing force across the retention device (414) which shears the retention device (414). With the retention device (414) sheared, the lock tool housing (404) is movably located within the conduit seal housing (402). A retention shoulder (500) on the lock tool housing (404) may keep the lock tool housing (404) and the conduit seal housing (402) from completely disconnecting as shown in FIG. 5.

After, the retention device (414) is sheared, space is able to be created between the distal end (416) of the lock tool housing (404) and the conduit seal (400). This allows the conduit seal (400) to relax or de-energize in the vertical direction (128) which releases pressure on the conduit (204), and the annulus (412) may reform between the conduit (204) and the conduit seal (400). Thus, the conduit (204) may be free to move within the lock tool (200).

The locking dogs (300) may also have shear pins or a shear ring holding the locking dogs (300) in the lock profile (120). Pressure applied to the lock tool (200), through the production tubing (102), may shear the shear pins or the shear ring of the locking dogs (300) allowing the locking dogs (300) to unengaged from the lock profile (120) and re-enter the lock tool (200). With the locking dogs (300) inside the lock tool (200), the lock tool (200) along with the BHA (202) and the conduit (204), may be removed from the production tubing (102). In other embodiments, the locking dogs (300) may be mechanically released from the lock profile (120) by running a lock tool shifting tool into the production tubing (102).

Figure 6B:
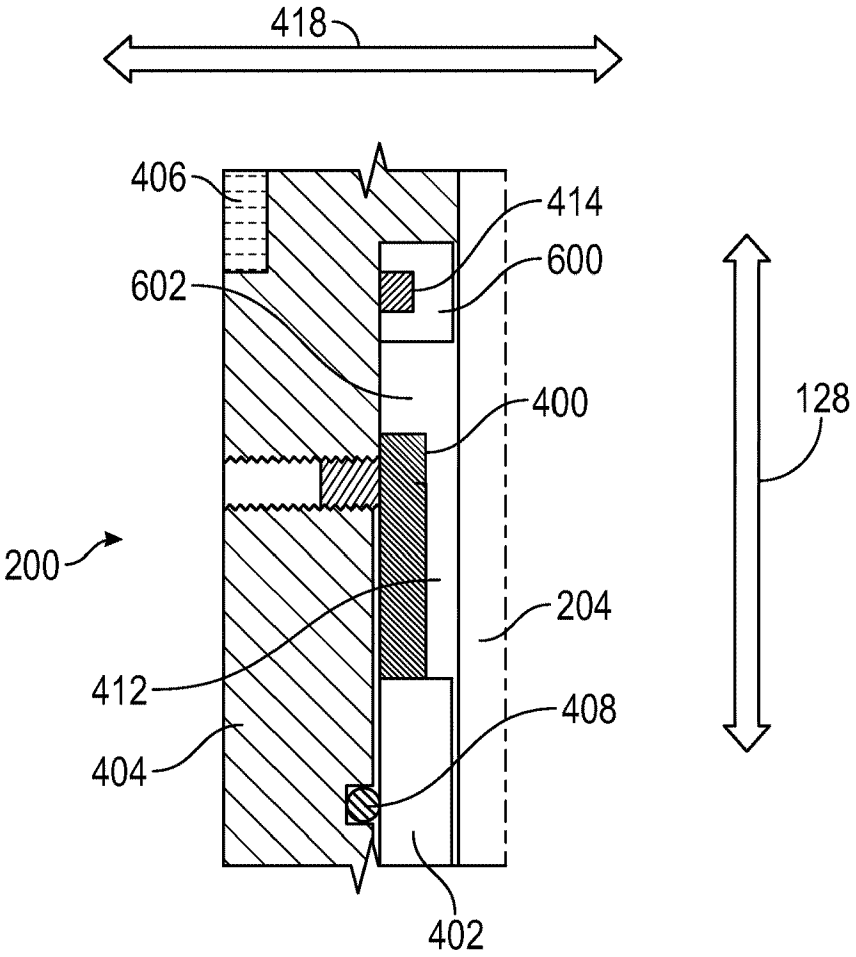
FIGS. 6*a* and 6*b* show a cross section of a lock tool in accordance with one or more embodiments.
Figure 6A:
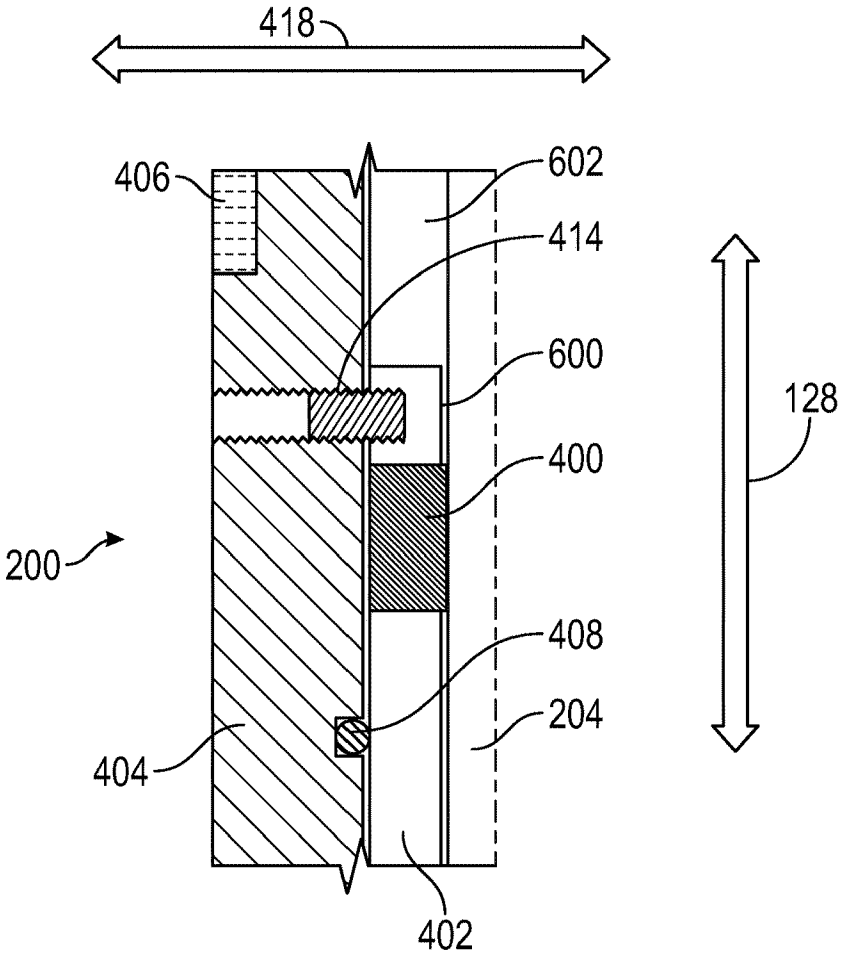

FIGS. 6*a* and 6*b* show a cross section of a lock tool (200) in accordance with one or more embodiments. Specifically, FIGS. 6*a* and 6*b* show an alternative method to retaining the conduit seal (400). Components in FIGS. 6*a* and 6*b* that are the same as or similar to components shown in FIGS. 1-5 have not been redescribed for purposes of readability and have the same function as described above.

FIGS. 6*a* and 6*b* show a cavity (602) created between the conduit seal housing (402) and the lock tool housing (404), the conduit seal (400) is disposed in said cavity (602). The conduit seal (400) is shown in the expanded position in FIG. 6*a*. The conduit seal (400) is able to seal the annulus (412) between the conduit seal (400) and the conduit (204) through the retention device (414) and the seal retainer (600) preventing the conduit seal (400) from expanding in the vertical direction (128).

In one or more embodiments, the seal retainer (600) may be a ring. The retention device (414) holds the seal retainer (600) proximate to the conduit seal (400), preventing vertical expansion of the conduit seal (400). When the retention device (414) is sheared, the seal retainer (600) may be able to move away from the conduit seal (400) (increasing the available cavity (602) volume), and the conduit seal (400) may relax and de-energize into the cavity (602). This may recreate the annulus (412) between the conduit seal (400) and the conduit (204). Further, the seal pressure and friction from the conduit seal (400) on the conduit (204) will decrease allowing the conduit (204) to freely move within the lock tool (200).

Figure 7:
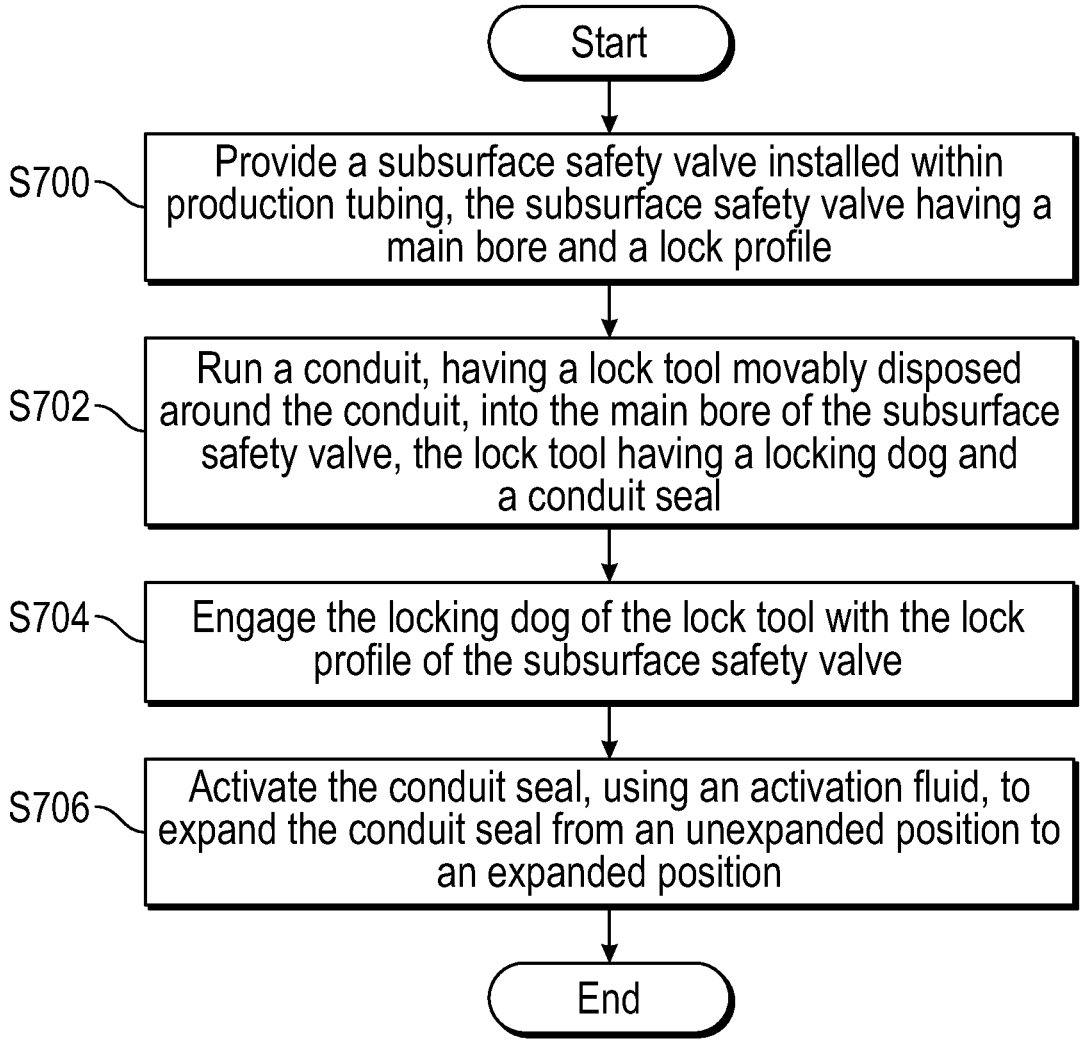
FIG. 7 shows a flowchart in accordance with one or more embodiments.

FIG. 7 shows a flowchart in accordance with one or more embodiments. Specifically, the flowchart illustrates a method for preventing flow in production tubing (102) using a SSSV (100) and a lock tool (200). Further, one or more blocks in FIG. 7 may be performed by one or more components as described in FIGS. 1-6*a*. While the various blocks in FIG. 7 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a SSSV (100), installed within the production tubing (102), is provided, the SSSV (100) has a main bore (106) and a lock profile (120) (S700). The SSSV (100) may be made of a first tube (112) located within a second tube (118). The main bore (106) may be located within the first tube (112) and an outer bore (108) may be located between an outer circumferential surface (114) of the first tube (112) and an inner surface (116) of the second tube. The lock profile (120) may be machined into the inner circumferential surface (110) of the first tube (112). The first tube (112) may have an opening (124) hydraulically connecting the outer bore (108) to the main bore (106). A closure sleeve (126) may be disposed around the first tube (112).

The closure sleeve (126) may have an open position and a closed position. The open position is when the closure sleeve (126) is not covering the opening (124) of the first tube (112) (as shown in FIGS. 1-3), thus the outer bore (108) is hydraulically connected to the main bore (106) through the opening (124). The closed position is when the closure sleeve (126) is covering the opening (124) of the first tube (112) and the hydraulic connection between the outer bore (108) and the main bore (106) is cut off. The closure sleeve (126) may naturally stay in the closed position until a pressure is exerted on the closure sleeve (126), through a hydraulic control line (130), to place the closure sleeve (126) in the open position.

A conduit (204), having a lock tool (200) movably disposed around the conduit (204), is run into the main bore (106) of the SSSV (100), the lock tool (200) having a locking dog (300) and a conduit seal (400) (S702). In other embodiments, the conduit (204) is connected to a BHA (202) being lowered into the production tubing (102) to perform some type of workover operation or equipment placement. The conduit (204) may be wireline, slickline, coiled tubing, etc. The lock tool (200) may be temporarily fixed to the conduit (204) using a shear-able mechanism. As the lock tool (200) is being run in to the production tubing (102), the locking dog (300) may be disengaged and be located within the lock tool (200) as depicted in FIG. 2.

Upon the lock tool (200) reaching the lock profile (120) of the SSSV (100), the locking dog (300) may be actuated using pressure actuation or mechanical actuation. Actuation of the locking dog (300) allows the locking dog to jut out from the lock tool (200) as shown in FIG. 3. The locking dog (300) of the lock tool (200) is engaged with the lock profile (120) of the SSSV (100) (S704). When the lock tool (200) is engaged within the SSSV (100), the shear-able device holding the lock tool (200) in place on the conduit (204) may be sheared due to continued downward movement of the conduit (204) and BHA (202).

Further, the lock tool (200) is sealed against the inner circumferential surface (110) of the SSSV (100) using a profile seal (406) disposed around the lock tool (200). With the lock tool (200) engaged in the SSSV (100), flow is prevented from traveling up hole through the main bore of the SSSV (100). The flow is diverted into the outer bore (108) of the SSSV (100). If the closure sleeve (126) is in the open position, the fluid (302) is able to surpass the lock tool (200) and re-enter the main bore (106). If the closure sleeve (126) is in the closed position, fluid (302) is unable to flow from the outer bore (108) to the main bore (106) and pressure is isolated on either side of the SSSV (100).

Fluid (302) is unable to pass through the inside of the lock tool (200), between the lock tool (200) and the conduit (204), due to the conduit seal (400). The conduit seal (400) is activated, using an activation fluid (302), to expand the conduit seal (400) from an unexpanded position to an expanded position (S706). Upon contact with the activation fluid (302), the conduit seal (400) is expanded in a horizontal direction (418), towards the conduit (204). A distal end (416)

of a lock tool housing (404) presses against the conduit seal (400) preventing vertical expansion of the conduit seal (400), and an annulus (412) is sealed between the conduit seal (400) and the conduit (204). In other embodiments, a seal retainer (600) presses against the conduit seal (400) preventing vertical expansion of the conduit seal (400).

The conduit seal (400) may be disengaged by shearing a retention device (414) holding the lock tool housing (404) in place within a conduit seal housing (402). After the retention device (414) is sheared the lock tool housing (404) may be movable within the conduit seal housing (402), the conduit seal (400) may expand, or de-energize, in the vertical direction to unseal the annulus (412) between the conduit seal (400) and the conduit (204).

In other embodiments, the conduit seal (400) may be disengaged by shearing the retention device (414) holding the seal retainer (600) in place within the cavity (602) formed between the lock tool housing (404) and the conduit seal housing (402). Upon shearing of the retention device (414), the seal retainer (600) is able to move within the cavity (602) and enable the conduit seal (400) to de-energize in the vertical direction (128). The retention device (414) may be sheared by pumping a fluid (302) onto the lock tool (200), through the production tubing (102), from a surface location. In further embodiments, the locking dog (300) may be disengaged in a similar manner to remove the lock tool (200) from the SSSV (100). As the conduit (204) and the BHA (202) are removed from the production tubing (102), the BHA may catch the lock tool (200) to bring the lock tool (200) to the surface.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A system for production tubing, the system comprising:
- a subsurface safety valve installed within the production tubing, the subsurface safety valve comprising:
  - a main bore delineated by an inner circumferential surface of the subsurface safety valve; and
  - a lock profile machined into the inner circumferential surface of the subsurface safety valve; and
- a lock tool movably disposed around a conduit, the lock tool comprising:
  - a locking dog configured to engage with the lock profile of the subsurface safety valve;
  - a conduit seal made of a swellable elastomer, activated by an activation fluid, the conduit seal having an expanded position and an unexpanded position;
  - a conduit seal housing having the conduit seal located on an inner surface of the conduit seal housing; and
  - a lock tool housing having the locking dog and a distal end, wherein the distal end extends into the conduit seal housing to the conduit seal, wherein the lock tool housing is removably connected to the conduit seal housing and the distal end of the lock tool housing is configured to prevent the conduit seal from expanding in a vertical direction when moving from the unexpanded position to the expanded position.

2. The system of claim 1, wherein the lock tool housing is removably connected to the conduit seal housing using a retention device that extends from the conduit seal housing to the lock tool housing.

3. The system of claim 2, wherein the retention device has a sheared position and an unsheared position, the unsheared position holding the lock tool housing in a fixed position against the conduit seal and the sheared position allowing the lock tool housing to move away from the conduit seal.

4. The system of claim 1, wherein the expanded position has an inner diameter smaller than an outer diameter of the conduit.

5. The system of claim 1, wherein the expanded position is initiated by contact with the activation fluid.

6. The system of claim 1, further comprising a closure sleeve installed on an outer circumferential surface of the subsurface safety valve.

7. The system of claim 1, further comprising a profile seal disposed around the lock tool and configured to seal against the inner circumferential surface of the subsurface safety valve.

8. The system of claim 1, wherein the unexpanded position has an inner diameter greater than an outer diameter of the conduit.

9. A method for production tubing, the method comprising:
- providing a subsurface safety valve installed within the production tubing, the subsurface safety valve comprising a main bore and a lock profile;
- running a conduit, having a lock tool movably disposed around the conduit, into the main bore of the subsurface safety valve, the lock tool comprising;
  - a conduit seal housing having a conduit seal located on an inner surface of the conduit seal housing and
  - a lock tool hosing having a locking dog and a distal end, wherein the distal end extends into the conduit seal housing to the conduit seal and the lock tool housing is removably connected to the conduit seal housing;
- engaging the locking dog of the lock tool with the lock profile of the subsurface safety valve; and
- activating the conduit seal, using an activation fluid, to expand the conduit seal from an unexpanded position to an expanded position, wherein the conduit seal is prevented from expanding in a vertical direction due to the distal end of the lock tool housing being located at the conduit seal.

10. The method of claim 9, wherein activating the conduit seal to expand the conduit seal from the unexpanded position to the expanded position further comprises expanding the conduit seal in a horizontal direction, towards the conduit, using the lock tool housing.

11. The method of claim 10, wherein expanding the conduit seal in the horizontal direction, towards the conduit, using the lock tool housing further comprises sealing an annulus between the conduit seal and the conduit.

12. The method of claim 11, further comprising disengaging the conduit seal.

13. The method of claim 12, wherein disengaging the conduit seal further comprises shearing a retention device holding the lock tool housing in place within the conduit seal housing.

14. The method of claim 13, wherein shearing the retention device holding the lock tool housing in place within the conduit seal housing further comprises allowing the conduit seal to expand in the vertical direction to unseal the annulus between the conduit seal and the conduit.

15. The method of claim 9, wherein the expanded position has an inner diameter smaller than an outer diameter of the conduit.

16. The method of claim 9, wherein the unexpanded position has an inner diameter greater than an outer diameter of the conduit.

17. The method of claim 9, wherein activating the conduit seal, using the activation fluid, to expand the conduit seal from the unexpanded position to the expanded position further comprises placing the conduit seal in contact with the activation fluid.

18. The method of claim 9, wherein engaging the locking dog of the lock tool with the lock profile of the subsurface safety valve further comprises sealing against an inner circumferential surface of the subsurface safety valve using a profile seal disposed around the lock tool.

* * * * *